US007908804B2

(12) United States Patent
Vieira

(10) Patent No.: US 7,908,804 B2
(45) Date of Patent: Mar. 22, 2011

(54) STRUCTURAL LINTEL ASSEMBLY AND BUILDING CONSTRUCTION METHOD USING THE SAME

(76) Inventor: José Vieira, Blainville (CA)

( * ) Notice: Subject to any disclaimer, the term of this patent is extended or adjusted under 35 U.S.C. 154(b) by 552 days.

(21) Appl. No.: 11/855,527

(22) Filed: Sep. 14, 2007

(65) Prior Publication Data

US 2009/0071092 A1 Mar. 19, 2009

(51) Int. Cl.
*E04H 1/00* (2006.01)

(52) U.S. Cl. ..... 52/235; 52/204.2; 52/379; 52/699

(58) Field of Classification Search ..... 52/677, 52/703, 745.05, 127.3, 275, 2.15, 345, 346, 52/348, 351, 352, 353, 354, 355, 356, 379, 52/349, 204.2, 235, 513, 378, 699
See application file for complete search history.

(56) References Cited

U.S. PATENT DOCUMENTS

| | | | | | |
|---|---|---|---|---|---|
| 489,467 | A | * | 1/1893 | Deslauriers | 52/378 |
| 599,721 | A | * | 3/1898 | Merritt | 52/327 |
| 802,622 | A | * | 10/1905 | Van Den Bulcke | 52/393 |
| 1,051,719 | A | * | 1/1913 | Evered | 52/204.2 |
| 2,292,459 | A | * | 8/1942 | Martin | 52/204.2 |
| 3,458,184 | A | * | 7/1969 | Schlosser | 269/287 |
| 3,942,292 | A | * | 3/1976 | Robinson | 52/204.2 |
| 4,020,612 | A | | 5/1977 | Welch | 52/731 |
| 4,060,951 | A | * | 12/1977 | Gere | 52/508 |
| 4,106,746 | A | | 8/1978 | Baculo | 249/216 |
| 4,185,804 | A | | 1/1980 | Baculo | 249/20 |
| 4,561,279 | A | | 12/1985 | Wears | 72/218 |
| 5,048,254 | A | * | 9/1991 | Merlau | 52/483.1 |
| 5,377,471 | A | * | 1/1995 | Niese | 52/482 |
| 5,619,834 | A | * | 4/1997 | Chen | 52/509 |
| 5,816,008 | A | * | 10/1998 | Hohmann | 52/565 |
| 6,128,883 | A | * | 10/2000 | Hatzinikolas | 52/698 |
| 6,536,737 | B1 | | 3/2003 | Davis | |
| 6,761,345 | B1 | * | 7/2004 | Reyneveld | 249/9 |
| 6,807,790 | B2 | | 10/2004 | Strickland et al. | |

(Continued)

FOREIGN PATENT DOCUMENTS

CA 2 069 310 4/1991

(Continued)

OTHER PUBLICATIONS

International Search Report, PCT/CA2007/001632, Jun. 12, 2008, 3 Pages.

(Continued)

*Primary Examiner* — B. Glessner
*Assistant Examiner* — Matthew J Gitlin
(74) *Attorney, Agent, or Firm* — St. Onge Steward Johnston & Reens LLC

(57) ABSTRACT

A prefabricated form assembly for making a concrete floor is disclosed. The form comprises an elongated form plate having a front for forming and retaining a flowable concrete material before it sets, anchor elements extending from the back face of the form plate, and being destined to be embedded into the concrete floor; and an L-shaped lintel having a back wall connected to the front face of the form plate and a bearing wall for supporting a masonry wall. Advantageously the construction of a concrete floor adapted to structurally retain a masonry wall using prefabricated form assemblies according to the invention no more requires the use of different groups of workers from different building trades as in the prior art, only one group of workers is required.

11 Claims, 11 Drawing Sheets

U.S. PATENT DOCUMENTS

| | | | | |
|---|---|---|---|---|
| 2002/0063956 | A1 | 5/2002 | Edwards et al. | 359/449 |
| 2004/0042222 | A1 | 3/2004 | Childs | 362/432 |
| 2004/0200166 | A1* | 10/2004 | Guth | 52/378 |
| 2005/0086881 | A1 | 4/2005 | Greenberg et al. | 52/292 |
| 2005/0204658 | A1 | 9/2005 | Patterson | 52/204.2 |
| 2005/0284045 | A1 | 12/2005 | Smith | 52/204.2 |
| 2006/0265982 | A1 | 11/2006 | Greenberg et al. | 52/293.1 |
| 2007/0022699 | A1 | 2/2007 | Wang | 52/656.4 |
| 2008/0053015 | A1* | 3/2008 | Matechuk | 52/235 |

FOREIGN PATENT DOCUMENTS

| | | |
|---|---|---|
| DE | 32 43 976 | 5/1984 |
| EP | 0 945 584 | 9/1999 |
| FR | 2 551 484 | 3/1985 |
| FR | 2 623 548 | 5/1989 |
| FR | 2 797 574 | 2/2001 |
| FR | 2 849 081 | 6/2004 |
| FR | 2 858 826 | 2/2005 |
| GB | 2 016 568 | 9/1978 |
| GB | 2 027 100 | 2/1980 |
| GB | 2 147 635 | 5/1985 |
| GB | 2 155 518 | 9/1985 |
| GB | 2 158 122 | 11/1985 |
| GB | 2 217 360 | 10/1989 |
| GB | 2 227 262 | 7/1990 |
| GB | 2 287 969 | 10/1995 |
| GB | 2 312 691 | 11/1997 |
| GB | 2 318 368 | 4/1998 |
| JP | 2 120451 | 5/1990 |
| JP | 5 163 875 | 6/1993 |
| JP | 6 073 967 | 3/1994 |
| JP | 8 013 953 | 1/1996 |
| JP | 8 060 940 | 3/1996 |
| JP | 9 032 518 | 2/1997 |
| JP | 9 144 447 | 6/1997 |
| JP | 10 148 058 | 6/1998 |
| JP | 11 006 364 | 1/1999 |
| JP | 11 210 157 | 8/1999 |
| JP | 2001/065067 | 3/2001 |
| JP | 2005/089982 | 4/2005 |
| WO | WO 96/15325 | 5/1996 |

OTHER PUBLICATIONS

Technical Notes on Brick Construction, 31B revised, reissued May 1987, Brick Industry Association, 11490 Commerce Park Drive, Reston, VA, 20191. 7 pages.

* cited by examiner

STRUCTURAL LINTEL ASSEMBLY AND BUILDING CONSTRUCTION METHOD USING THE SAME

FIELD OF THE INVENTION

The present invention pertains to the general field of building construction, building components and methods of construction and is particularly directed to an adjustable structural lintel assembly used for making and connecting a concrete floor with external walls, and a construction method using the same.

BACKGROUND OF THE INVENTION

Brick, stone and concrete structures are used extensively in the construction or building of residential, industrial, commercial, agricultural and other applications. Indeed, many structures are built from wood, brick, stone, concrete or a combination of these materials or similar materials because of their many advantages including strength, durability, temperature and sound insulation, fire resistance, general attractiveness and ease of maintenance.

Gravity forces acting on the facing material of a given structure can be transferred to major structural elements of the building, for example, beams, columns, concrete floor slabs or the like using steel rods and shapes attached with mechanical and/or welded connections to the structural elements. As is well known, it is necessary and required by some building codes when building a brick or a stone structure to provide support therefor in some instances. For examples, it is necessary and required by some building codes to provide support for such facing materials over openings in the building structure and when the facing material stands over a given height such as over more than one floor level.

The support for the facing material is typically provided by so-called lintels. Such conventional lintels are typically in the form of a substantially, horizontally disposed architectural member that is employed to span an opening in a building such as a window or a door or across a given width of a facing for carrying the load created by the facing. The lintels used in modern buildings of cement blocks, bricks, types of masonry construction have traditionally been fabricated of elongated heavy gauge angle iron. Lintels are generally made of steel or concrete because these materials are durable and inexpensive. The lintel is typically nailed, bolted or otherwise secured to the header forming the top of the opening or to a concrete floor slab. It may additionally be simply supported at each end by the brick or concrete just below the header outside the opening. One or more courses of brick are then placed on the lintel and are secured thereto typically using mortar. The lintel supports the weight of all the bricks or stones thereabove.

Structural lintels refer to the lintels that are typically used for supporting bricks, stones or the like used as facing material spanning from one floor level to the next. Typically, such structural lintels are secured to corresponding beams or slabs of concrete or the like used as flooring material by bearing having corresponding studs embedded within the concrete slab or beam.

The conventional method of securing a structural lintel to a concrete floor involves initially nailing or otherwise securing the bearing plate to the form used for moulding the concrete slab or beam. The bearing plate with its corresponding anchoring stud hence typically extends into the mould of the concrete slab or beam.

The concrete or similar material is then poured into the form and allowed to cure. Once the concrete has sufficiently cured, the forms forming the mould are removed leaving the bearing plate anchored to the now-cured concrete beam or slab with their corresponding studs embedded in the cured concrete.

This part of the job is typically performed by concrete/form workers part of conventional construction teams.

Once the forms are removed from the cured concrete slab or beam, another group of workers, typically referred to as steel workers such as structural steel installers must gain access to the location in order to perform the next building steps. The steel installers must then secure lintel spacers and the structural lintels themselves to the bearing plate.

Typically, the steel installers initially weld spacing tubes on the exterior surface of the bearing plates prior to welding the structural lintels to their corresponding spacing tubes. Alternatively, the spacing tubes and structural lintels are pre-assembled in an outside location such as an assembly shop or the like and brought in an assembled configuration to the construction site where they are welded as a single unit to the bearing plate.

Regardless of whether the spacing tubes and bearing plates are welded sequentially or as a pre-assembled unit to the bearing plate, the welding of the spacing tubes to the bearing plates is typically considered to be a tedious, time-consuming, costly and potentially hazardous process. One of the reasons why the mounting of the structural lintels and their associated spacing tubes is considered physical relates to the fact that the outer surface of the bearing plates on which the spacing tubes are to be welded often needs to be prepared or modified prior to the welding of the spacing tubes on the bearing plates. Indeed, when the moulding forms are removed from the cured or hardened concrete, the outer surface of the concrete in contact with the forms often does not present a perfectly aligned and smooth surface. Variables such as the positioning of the moulding forms, the type of structure or anchor used for maintaining the forms aligned during pouring and curing of the concrete, the type of concrete used, the conditions during curing of the concrete and other variables cooperate in varying degrees to imperfections to the outer surface of the concrete slab or beam and in the relative positioning of the outer surface of the bearing plate relative to the adjacent outer surface of the concrete beam or slab.

For example, the bearing plates may be slightly misaligned or out of register with the outer surface of the concrete slab or beam so that at least a portion of the outer surface of the bearing plates often is either embedded too deeply relative to the outer surface of the concrete slab or beam, or sticks out too far therefrom. Sometimes, the imperfections in the outer surface of the concrete slab or beam are such that such imperfections in themselves cause interference to the welding of the spacing tubes to the outer surface of the bearing plate.

Regardless of the reason, on site modifications often need to be performed on either the concrete slab or beam or the bearing plates prior to welding of the spacing tubes to the outer surface of the bearing plates. For example, the bearing plates may need to be cut using a torch or additional levelling components may need to be welded or otherwise secured to the bearing plates. Such on-site modifications require that specialized and skilled workmen spend a considerable amount of time. The delays caused by the need for a correction of imperfections in the alignment of the outer surface of the bearing plates relative to the outer surface of the concrete slab or beam sometimes slow down other steps in the overall construction of a building. Also, the required on-site modifications are sometimes of the type that may be potentially hazardous such as in situations wherein a torch is required for cutting through a portion of a bearing plate or the like.

Accordingly, there exists a need for an improved method and device for building a concrete floor and anchoring structural lintels thereto.

SUMMARY OF THE INVENTION

An object of the present invention is to provide a form assembly suitable for making a concrete floor and that satisfies the above-mentioned need. In accordance with the present invention, that object is achieved with a prefabricated form assembly comprising an elongated form plate having a front and a back face, for forming and retaining a flowable concrete material before it sets and a substantially L-shaped lintel having a back wall secured to the front face of the form plate and a bearing wall for supporting a masonry wall. The assembly further comprises at least one anchor element destined to be embedded into the concrete floor and which extends from the back face of the form plate.

By prefabricated, it is meant an assembly manufactured in advance in factory, especially in standard sections that can be easily shipped and used directly on the site of construction. The assembly can be used for example in the construction of a building or section of a building, more specifically for making a concrete floor able to structurally support a masonry wall.

As for conventional forms made of wood and used for moulding a concrete slab, the elongated form plate has a horizontal length adapted to span the length of the floor to be built. It is used and assembled with other elongated form plates to form a mould for the flowable concrete material. The vertical width of the form plate is preferably identical to the widths of the adjacent plates, and superior or equal to the final desired width of the concrete floor to build.

Two elongated form plate may also be preassembled to form corners such as inside or outside corners.

The present invention is also directed to a method for making a concrete floor comprising the following steps of:

a) providing a plurality of prefabricated form assemblies as just defined in above;
b) installing a temporary supporting floor and assembling the form plates of the prefabricated form assemblies to form a mould, the anchor element(s) of the prefabricated form assemblies extending into the mould;
c) pouring a flowable concrete material into the mould;
d) letting the flowable concrete material to set; and
e) removing temporary supporting floor.

It has to be understood that the number and size of each prefabricated form assembly provided in step a) of the above method, depends on the size and shape of the final mould to assemble, and thus to the final concrete floor to build. As aforesaid, each assembly is manufactured in advance, especially in standard sections that can be easily shipped and assembled on the site of construction to form the desired moulds.

Any sort of temporary supporting floor used in the art of building construction may be used in step b) of the above mentioned method. The supporting floor is generally supported itself by the foundations of the building or by pre-built beams, girders or supporting walls. The supporting floor is generally made of strong wood such as plywood.

Flowable concrete material encompasses any kind of building material produced from a mixture of stone, gravel, sand, pebble or slag with water and/or a binding material that can harden to form a hard, strong construction material gravel; including but not limited to ordinary concrete, reinforced concrete or pre-stressed concrete.

By anchor element, it is meant any type of device used to structurally secure the plate once the concrete is set and that remains in place or maintains its position so that the plate is strong enough to bear the weight of the masonry wall. The anchor element may have the form of a rod or a stick having one of its free ends substantially bent, the other end being secured to the form plate. The invention is not limited to this specific shape of an anchor element.

By masonry wall it has to be understood any stonework or brickwork or any sort of wall made, for example, of stones, bricks, breezeblocks, cinderblocks, or pre-formed concrete or wood panels.

Advantages of the present invention include that the proposed method and device allows for the securing or anchoring of structural lintels to concrete slabs or beams through a set of relatively quick, ergonomic and unhazardous steps, thanks mainly to the fact that no more welding process is required in place the lintel arrives on the site of construction already secured to the form plate.

Another advantage is the fact that the construction of a concrete floor adapted to structurally retain a masonry wall no more requires the use of two different groups of workers from different building trades as in the prior art discussed above.

The proposed method and device is thus more economical, less time-consuming and less dangerous than the conventional methods and devices detailed above used for anchoring structural lintels to concrete slabs or beams.

According to a preferred aspect of the invention, the prefabricated form assembly may further comprise at least one spacing element interconnecting the lintel to the form plate, thereby leaving a gap between the form plate and the lintel. The presence of this gap may be used for example for covering the inside surface of the masonry wall with an insulated material.

According to another preferred aspect of the invention, the prefabricated form assembly has its lintel vertically movable with respect to its form plate for levelling the lintel before building up the masonry wall. In a case where a spacing element interconnects the lintel to the form plate, the lintel is vertically movable with respect to the spacing element, the spacing element being itself fixed, for example by welding, to the form plate.

A further advantage of using the prefabricated form assembly and method of the present invention resides in the fact that there is no more need for performing steps in order to ensure that the outer surface of conventional form plates be in register or proper alignment with a corresponding adjacent outer surface of the concrete slab or beam into which the form plates and their corresponding anchoring elements are embedded. Accordingly, and as mentioned above the anchoring of the prefabricated form assembly may be performed by a single class of building trades, namely concrete/form workers and/or masonry workers without requiring steel workers for performing tedious, time-consuming and potentially dangerous torching and welding for the correction of imperfections.

The invention and its advantages will be better understood upon reading the following description made with reference to the accompanying drawings.

DETAILED DESCRIPTION OF THE INVENTION

Figure 1:
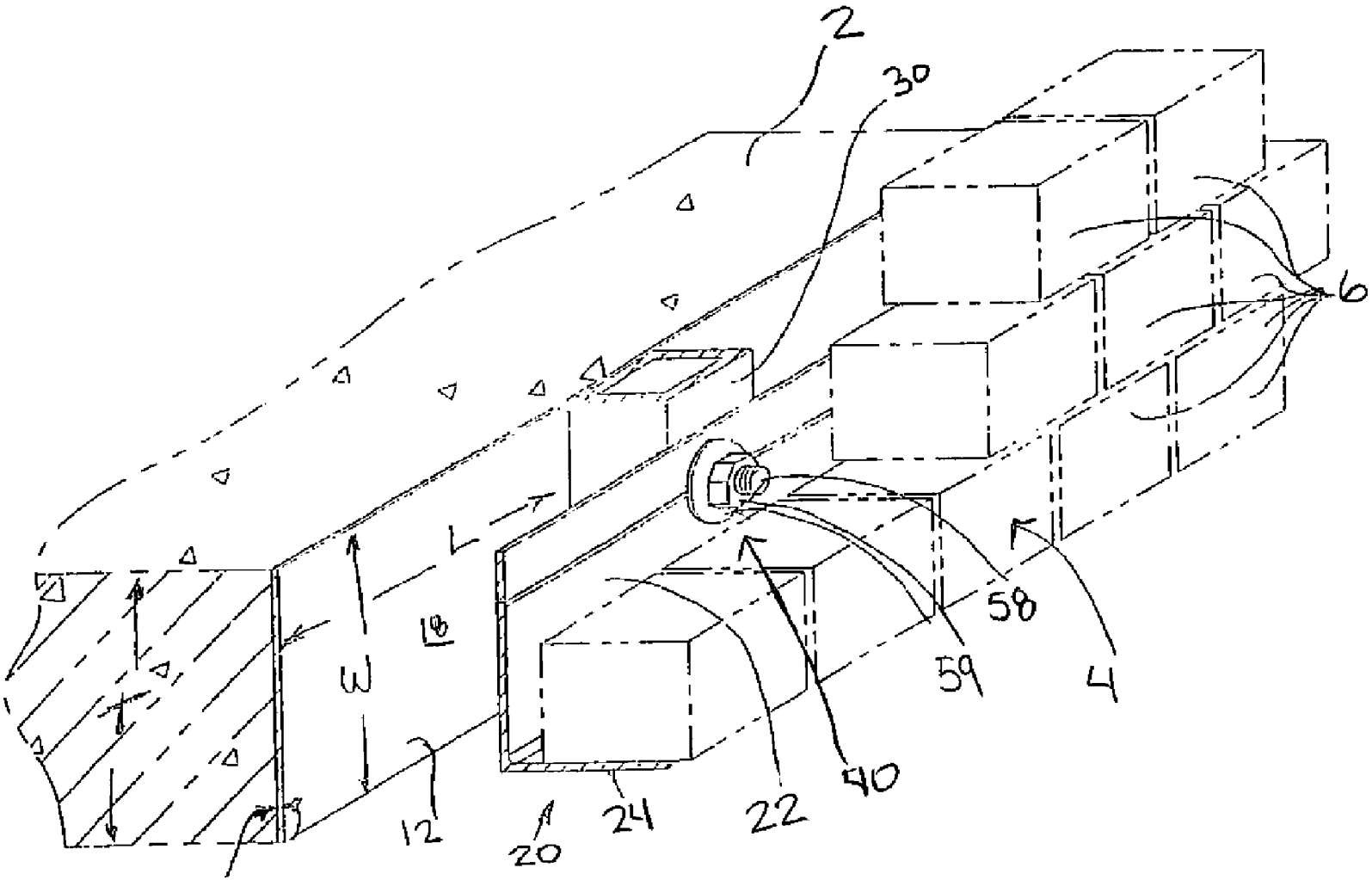
FIG. 1 is a general perspective view of a prefabricated form assembly according to a preferred embodiment of the invention showing a concrete slab that has been poured and a masonry wall under construction.

In the following description, similar features in the drawings have been given similar reference numerals and in order to lighten the figures, some elements are not referred to in some figures if they were already identified in a preceding figure.

Also, in order to ease the reading of following description, it will always be considered that the concrete floor described is built upon a pre-existing inferior level of a building. In other word, the concrete floor described corresponds to at least the second level of a building. However it has to be understood that the object and method of the invention may be used for the construction of each floor of the building in construction.

As aforesaid, and referring to FIG. 1, the present invention concerns a prefabricated form assembly 10 adapted to both built a concrete floor 2 and a masonry wall 4 structurally retained by the concrete floor 2. The assembly 10 is manufactured in advance, especially in standard sections that can be easily shipped and assembled on the site of construction.

Referring to any of FIGS. 1 to 9, the prefabricated form assembly 10 comprises an elongated form plate 12 for forming the concrete floor 2 or slab ; The elongated form plate 12 is generally made of a metallic strong and rigid material which cannot be pulled out of shape under pressure. It is configured and sized so as to be able to withstand structural stresses imparted thereon. Typically, although by no means exclusively, the form plate 12 is made out of steel and has a thickness in the range of 3 to 4 millimeters. It is adapted to act as a mould or a form for limiting the flow of concrete prior to the latter being solidified or cured.

Still referring to FIGS. 1 to 9, the form assembly 10 further comprises a substantially L-shaped lintel 20 used for building and supporting the masonry wall 4. The lintel 20 has a back wall 22 secured to the front face 18 of the form plate 12 and a bearing wall 24 for supporting the masonry wall 4. The lintel 20 could be directly secured to the form plate 12, for example by welding, bolting or by using any other securing means known in the construction field or, as shown in the drawings, the lintel 20 could be indirectly secured to the form plate 12 by using at least one spacing elements 30 interconnecting the lintel 20 and the form plate 12, and thereby leaving a gap 31 between the form plate 12 and the lintel 20. This gap 31 may be used, for example, to insert between the masonry wall 4 and an inside wall (not illustrated) various construction or structural elements and/or insulation materials. The inside wall is generally made of plaster wall such as Gyproc® or the like well known in the art, maintained by joists placed and fixed inside the gap. The spacing elements 30 will be described in more details further below.

Figure 10:
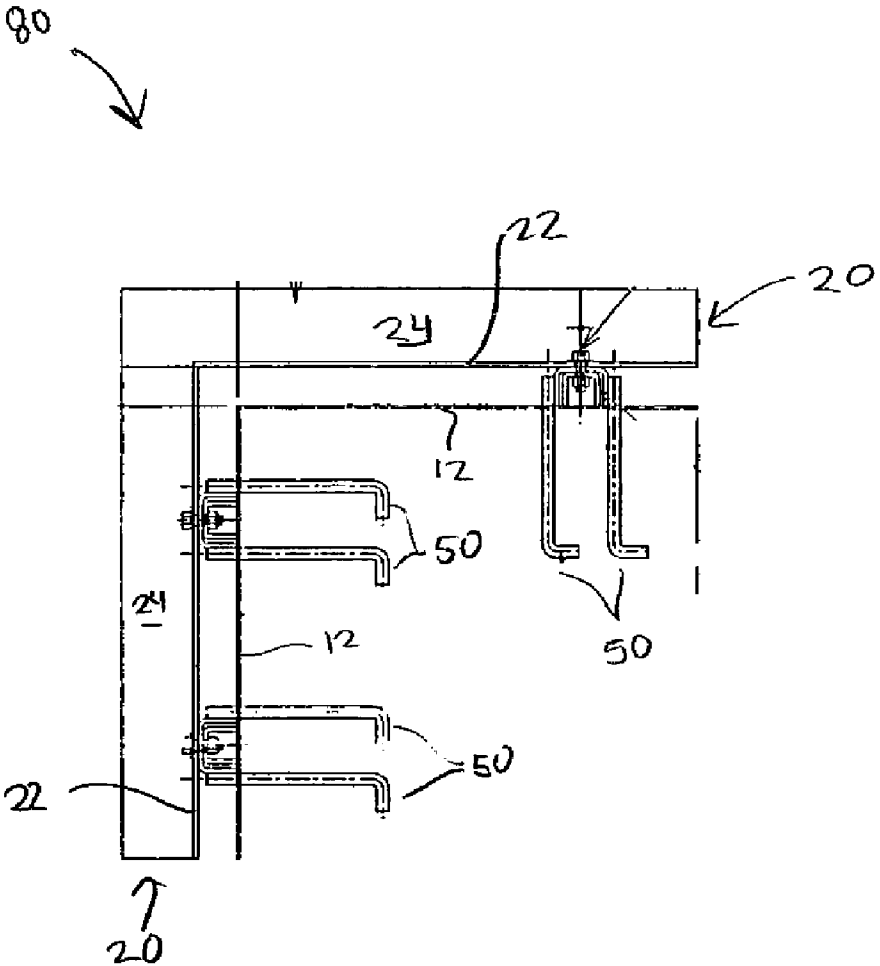
FIG. 10 is a top view of two prefabricated form assemblies assembled to make an outside corner.
Figure 11:
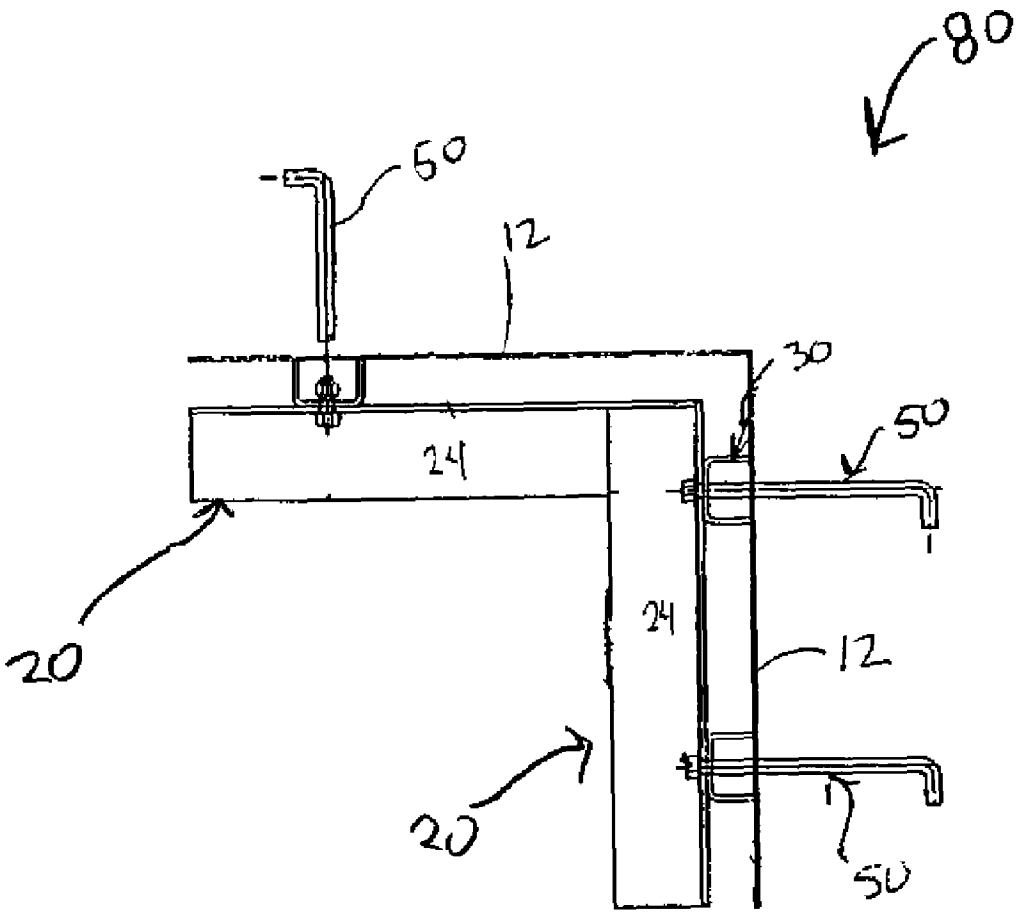
FIG. 11 is a top view of two prefabricated form assemblies assembled to make an inside corner.

The lintel 20 is made of a material which cannot be pulled out of shape under the pressure exerted by the masonry wall. For example, the lintel may be made of steel, iron, or other metallic material generally used in this field. The length of the lintel 20 generally conformed to the length of the form plate 12. However, there could be situations where the lintel's length may be smaller or larger than the plate's length. For example, when two prefabricated form assemblies 10 are used for making an outside corner, as shown in FIG. 10 or an inside corner as shown in FIG. 11, the length of the lintel has to be respectively larger and shorter than the length of the plate The spacing elements 30 may have different configurations and shapes, not limited to the ones illustrated in the enclosed Figures. However, for the purpose of lightness and economy, each of the spacing elements 20 has a substantially U-shaped cross-section, such as the one illustrated on FIG. 2. It could also be a substantially square-shaped hollow tube such as the one illustrated on FIG. 1 and commonly referred as HSS tubes. However, the U-shape form has the advantage of facilitating the assemblage of the different components of the prefabricated assembly 10.

Figure 2:
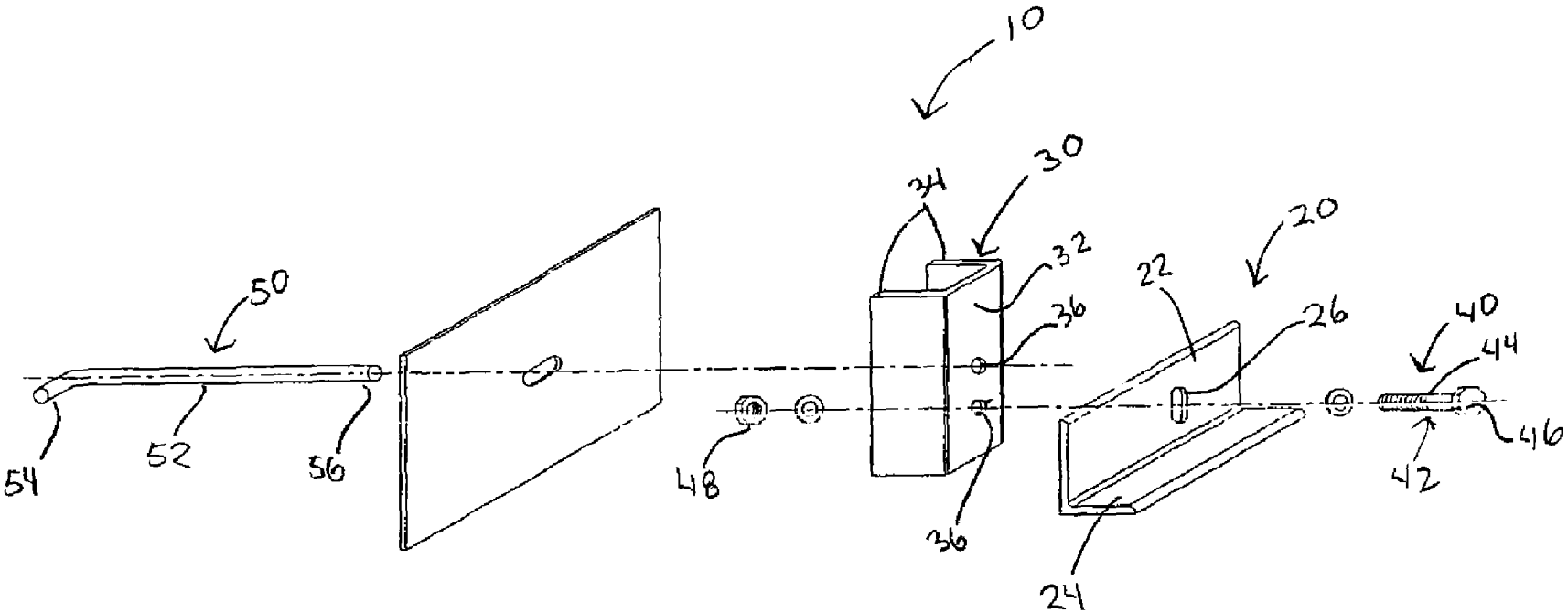
FIG. 2 is an exploded perspective view of a prefabricated form assembly according to another preferred embodiment of the invention.
Figure 3:
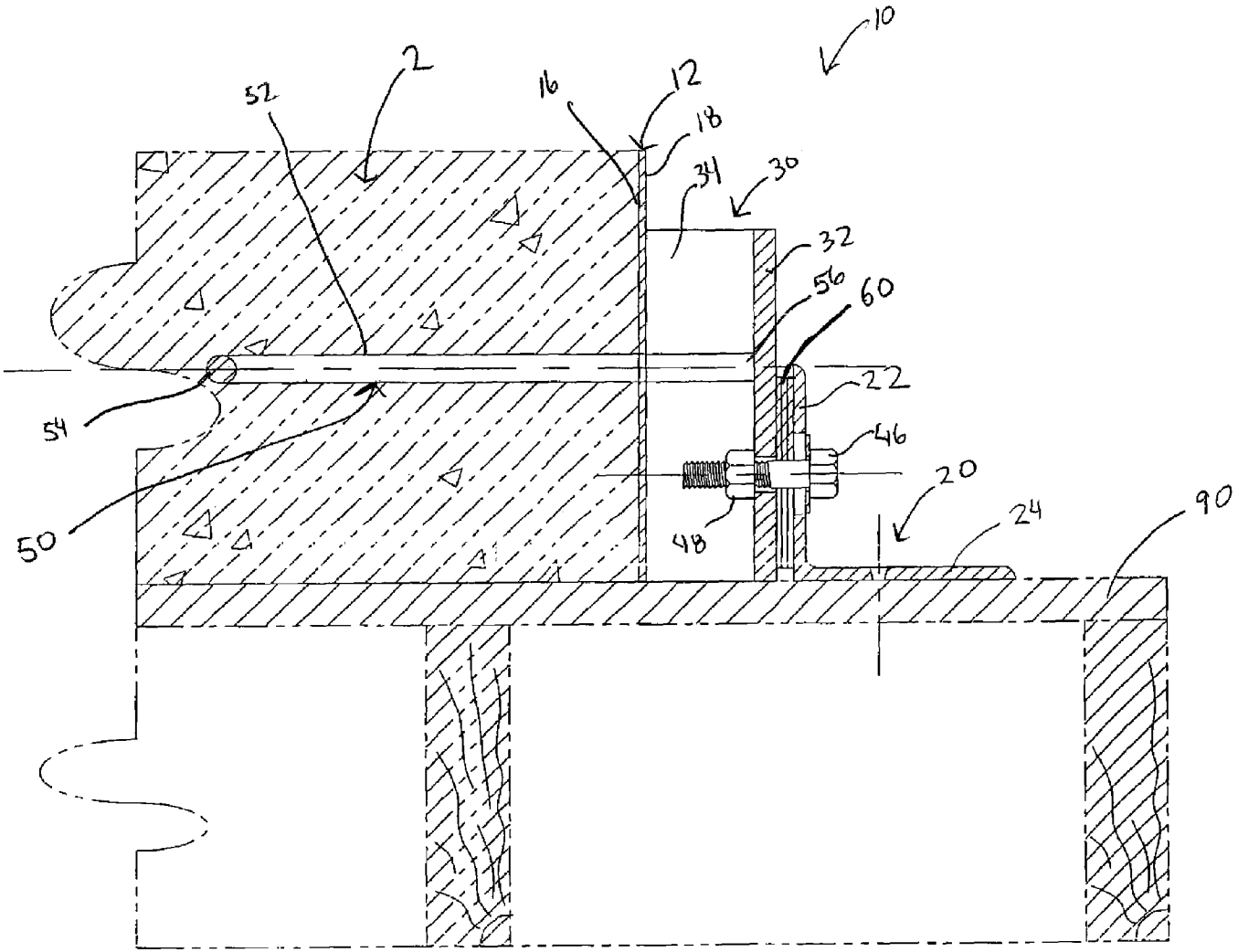
FIG. 3 is a cross-sectional side view of the prefabricated form assembly of FIG. 2 in use, and showing a just poured concrete slab supported by a temporary supporting floor.
Figure 4:
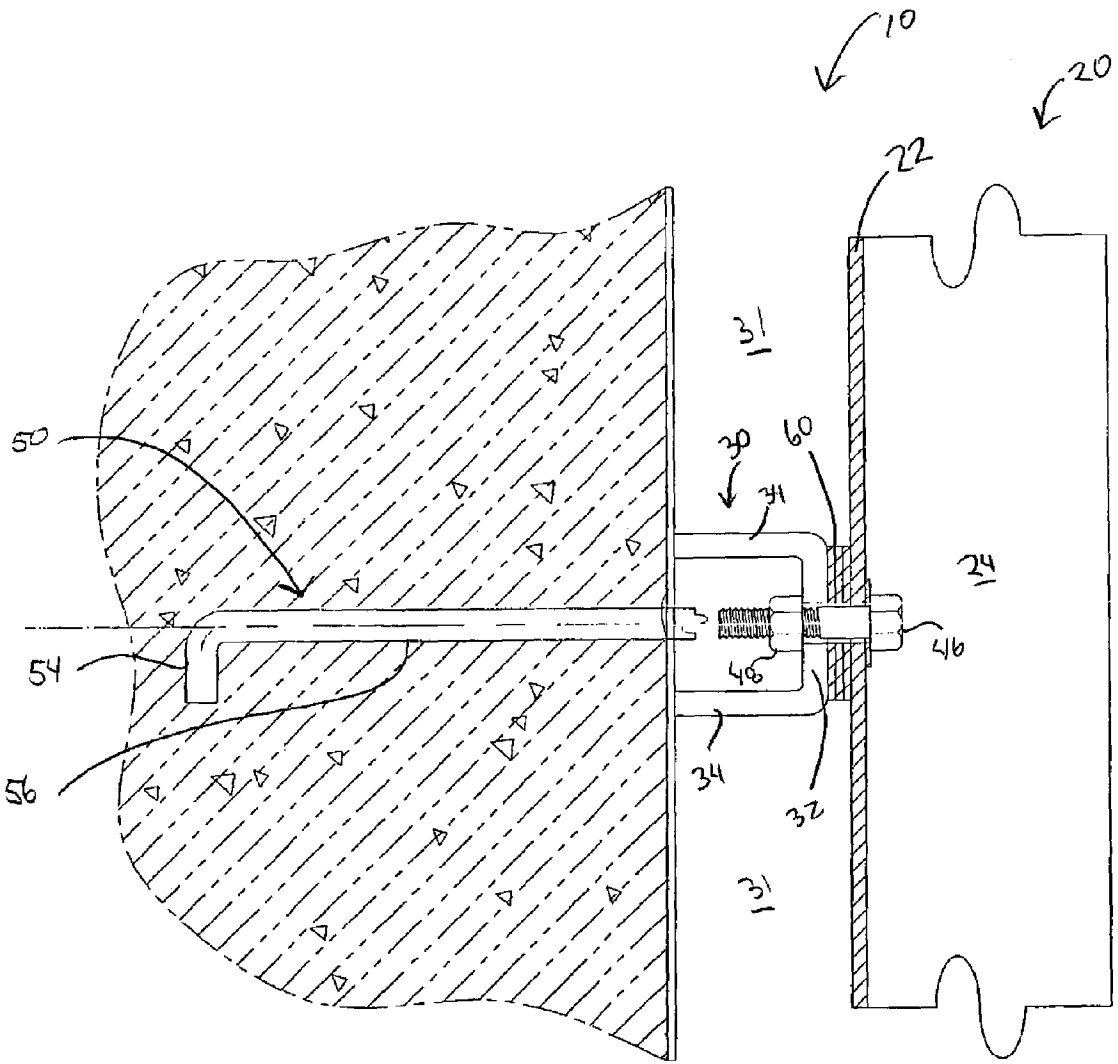
FIG. 4 is a top view of the prefabricated form assembly illustrated in FIG. 3.
Figure 5:
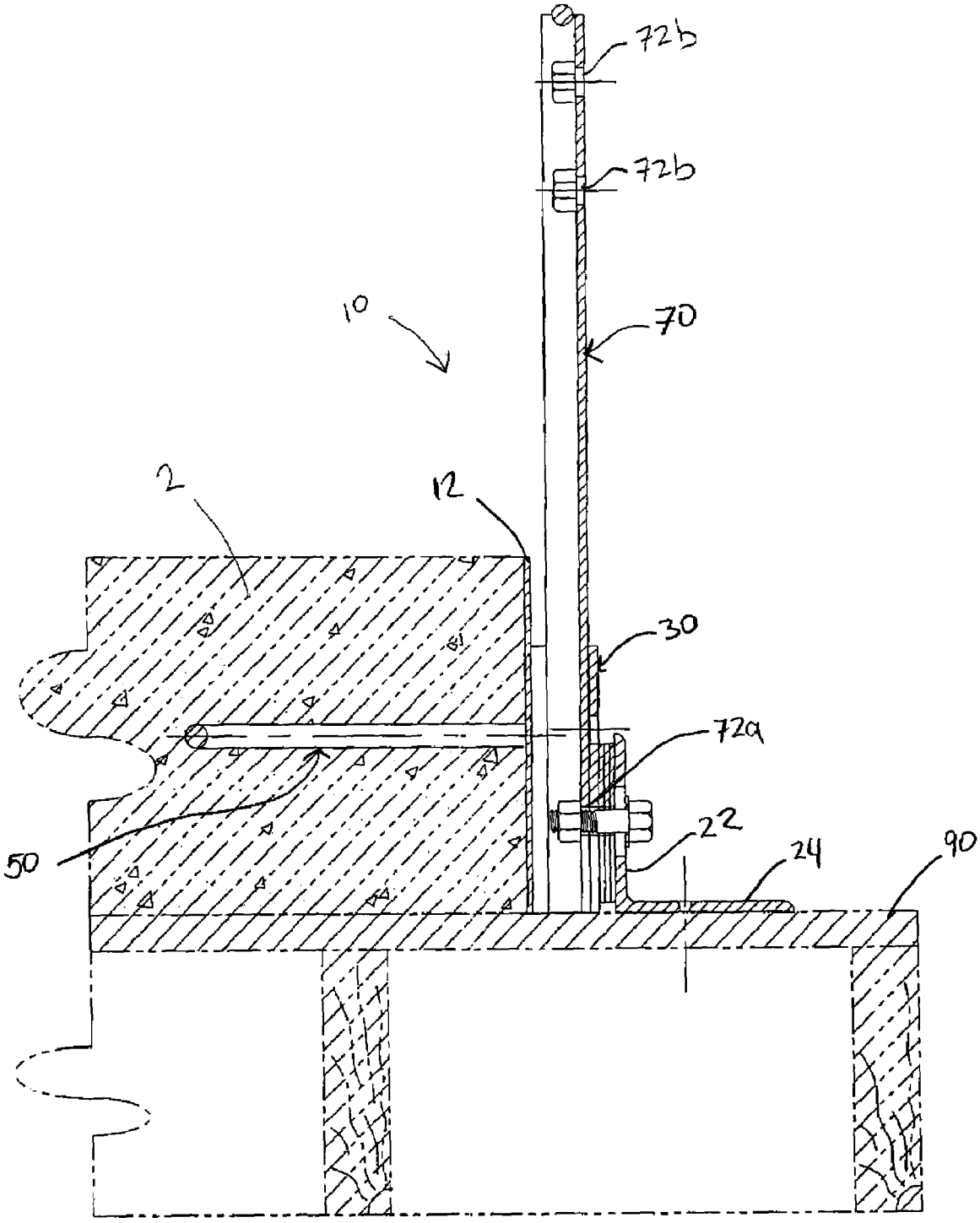
FIG. 5 is a cross-sectional side view of a prefabricated form assembly according to a further preferred embodiment of the invention which includes an adjustment bar, the assembly being shown in use with a just poured concrete slab supported by a temporary supporting floor.
Figure 6:
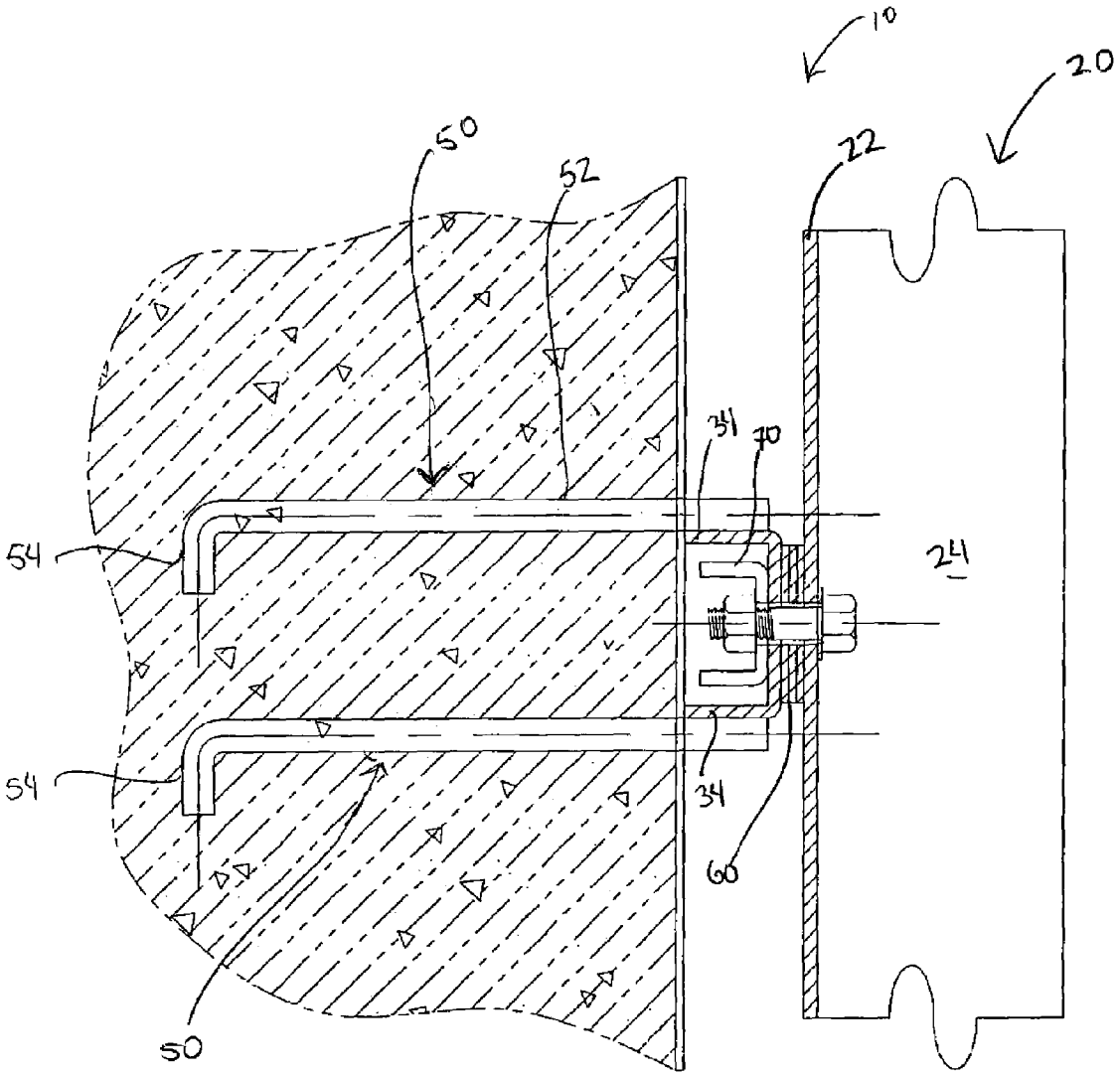
FIG. 6 is a top view of the prefabricated form assembly of FIG. 5.
Figure 7:
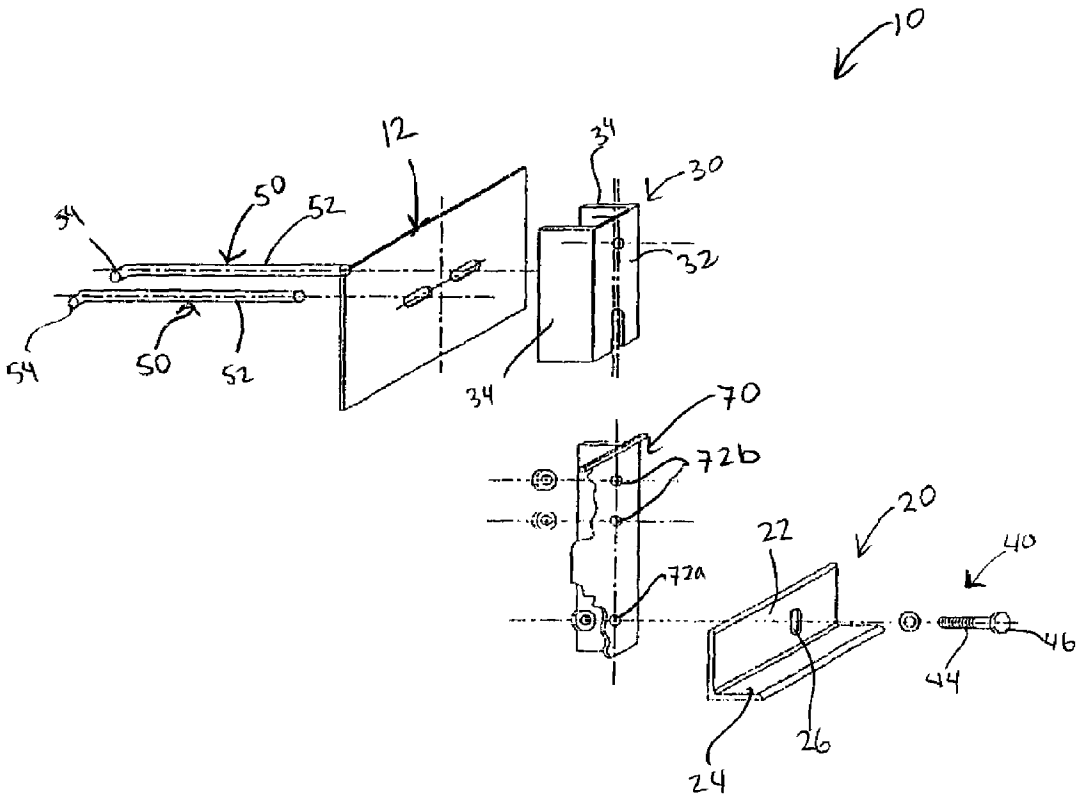
FIG. 7 is an exploded perspective view of the prefabricated form assembly illustrated in FIG. 6.

Turning to FIG. 2, each of the U-shaped spacing elements 30 comprises a base wall 32 facing the back wall 22 of a lintel 20 and two lateral walls 34 secured to the front face 18 of the form plate 12. The base wall 32 is also provided with at least one screw-receiving hole 36 for receiving an adjustable fastener 40 as will be described further below.

Anchor elements 50 (not visible on FIG. 1) extending from the back face 16 of the form plate 12 and destined to be embedded into the concrete floor 2 are also provided with the assembly 10 for structurally retaining the masonry wall 4 to the building 50. In the embodiments illustrated in FIGS. 1 or 2, there is one anchor element associated with each spacing element 30 whereas two anchor elements 50 are associated with each spacing element 30 in the embodiments shown in FIGS. 5 to 7. The anchor element 50 may have a rod-shaped portion 52 having one of its free end 54 substantially bent, the other end (hereinafter referred as to the second end 56) being directly or indirectly secured to the form plate 12. In the embodiments shown in FIGS. 1 or 2, the rod-shaped portion 52 of the anchor element 50 is crossing the form plate 12 and its second end 56 is welded to the base wall 32 of a respective spacing element 30. In the case of the embodiments shown in FIGS. 5 to 7, the rod-shaped portion 52 of each of the two anchor elements 50 is also crossing the form plate 12 but in that case the part of the rod-shaped portion 52 extending on the front side of the form plate 12 is welded to the outer face of a corresponding lateral wall 34 of the spacing element 30.

It is worth mentioning that the size and shape of the anchor element 50 used hereby in the present invention is not limited to the size and shape illustrated on the Figures and described in the present description. Any size and shape could be use as long as it can structurally secure the form plate 12 and the lintel 20 once the concrete has set so that the form plate 12 be strong enough to bear the weight of the masonry wall 4.

Another interesting feature of the preferred embodiments illustrated is the fact that they are designed so that the lintel 20 can be moved vertically with respect to the form plate 12, thereby allowing the masonry wall 4 to be easily levelled. Indeed, and as can be appreciated by referring for example to FIG. 2, the back wall 22 of the lintel 20 may be provided along its length with at least one vertical slot 26. Each slot is adapted to receive the adjustable fastener 40 connecting the back wall 22 to a respective one of the spacing elements 30. In the absence of spacing elements 30 (not illustrated), the vertical slot 26 would allow the lintel 20 to be movable with respect to the form plate 12. Otherwise, the lintel 20 is movable with respect to the spacing element 30 fixed to the front face 18 of the form plate 12. The level or horizontality of the lintel 20 may be adjusted by loosening/tightening the adjustable fastener 40. As illustrated on FIG. 2, each of the adjustable fastener 40 interconnecting the lintel 20 and the spacing element 30 (or the form plate 12) may comprise a bolt 42 having a threaded shank 44 inserted through the vertical slot 26 of the lintel 20 and the screw receiving hole 36 of the spacing element 30. The bolt 42 has a head 46 abutting the back wall 22 of the lintel 30. A nut 48 is mounted on the free end of the threaded shank 41, whereby the level of the lintel 20 is adjustable by loosening/tightening the bolt 42. Preferably, the nut 48 is fixed to the base wall 32 of the spacing element 30 in order to facilitate the screwing of the bolt 42.

Figure 8:
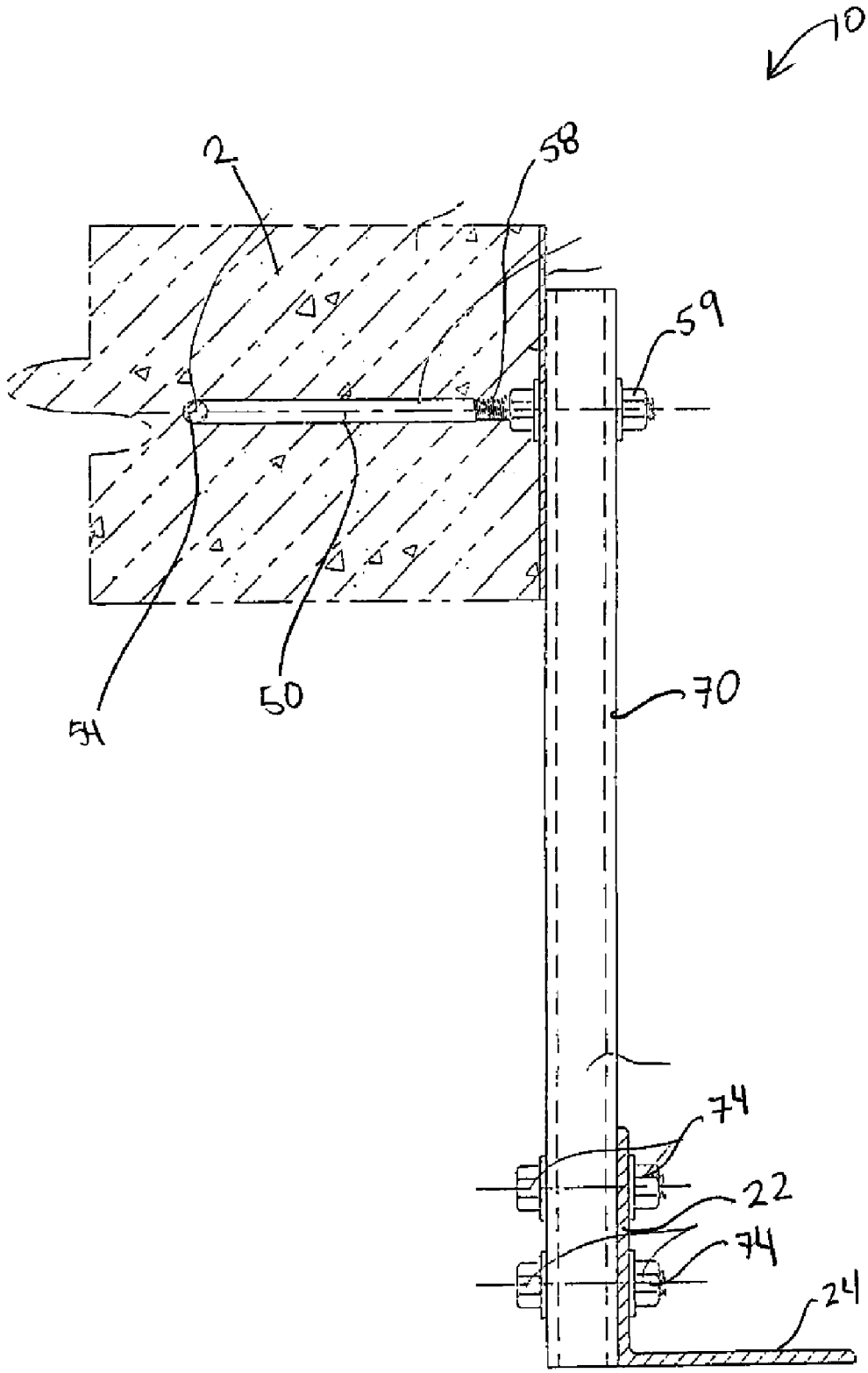
FIG. 8 is a side view of the prefabricated form assembly according to a still preferred embodiment of the invention which comprises and adjustment bar.
Figure 9:
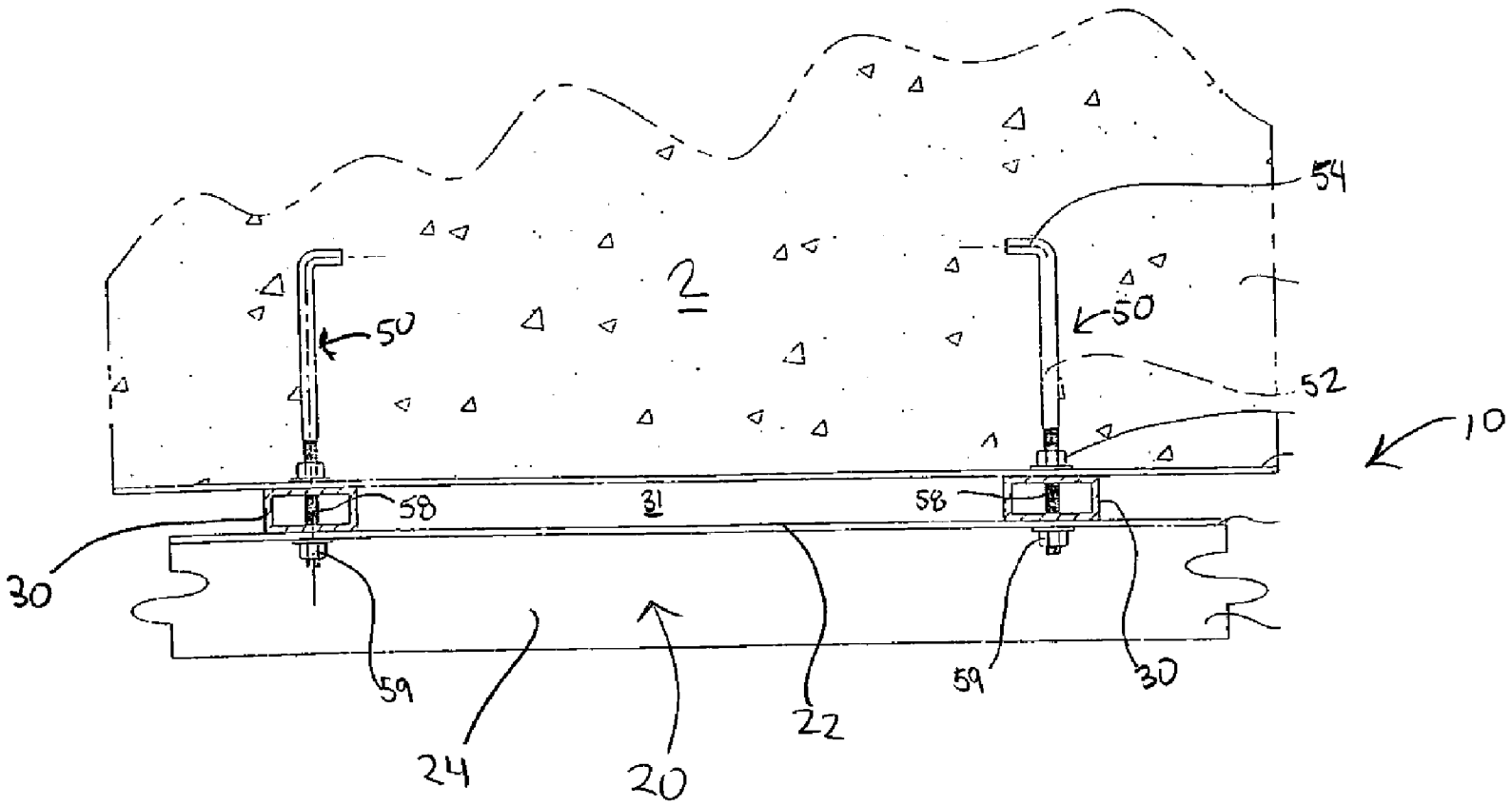
FIG. 9 is a top view of the form assembly of FIG. 1 without the masonry wall.

According to another preferred embodiment of the invention, such as the ones illustrated on FIG. 1 or 8, each of the adjustable fasteners 40 may be embodied by each of the anchor elements 50. In that case, the rod-shaped portion 52 of the anchor element 50 crosses together the form plate 12, the spacing element 30 and the vertical slot 26 in the lintel 20 and it has a threaded end 58 jutting out of the back wall 22 of the lintel 20. A nut 59 mounted to that threaded end 58 is used to loosen/tighten the lintel 20 for levelling the masonry wall.

Referring to FIGS. 3 to 6, shim plates 60 may also be used for facilitating alignment of the lintel 20. Typically, the shim plates 60 are provided with a shim plate slot for facilitating their insertion, for example, between the HSS tube and the lintel vertical segment (back wall 22) by merely sliding the shim plate 60 there between with the shim plate slot receiving a corresponding rod-shaped portion 52 of the anchor component 50.

Another interesting feature of the preferred embodiment shown in FIGS. 5 to 8 is the use of adjustment bars 70 which can be particularly helpful for erecting the masonry wall 4 on a facade of the building provided with window or door openings. For that particular purpose, the form assembly 10 comprises at least one adjustment bar 70 slidable within a respective U-shaped spacing element 30. The adjustment bar 70 is vertically extending through a hole delimited by the lateral walls 34 and base wall 32 of the spacing element 30. The adjustment bar 70 further comprises a plurality of fastener-receiving holes placed there along. One or two of these holes 72*a* can be use to secure the lintel 20 to the adjustment bar 70 and the others 72*b* are used to secure the adjustment bar 70 to the spacing element 30. These latter holes 72*b* can be positioned in front of the screw-receiving hole 36 of the base wall 32 of the spacing element 30 by sliding the bar 70 upwardly or downwardly with respect to the spacing element 30. Conventional fastener 5 such as a bolt 74 and nut 76 are used to secure the adjustment bar 70 to the spacing element 30 and the lintel 20 to the adjustment bar 70. For purposes of lightness and cost, the bar 70 is preferably a U-shaped bar.

Now referring to FIG. 8, and supposing that there is a window or door opening in the floor below the concrete slab 3. If a masonry wall 4 has to be erected over the that opening 1, the adjustment bars 70 of the form assembly 10 secured to the upper concrete slab 1 are lowered until the lintel 20 extends approximately at the level of the upper edge of the opening so that the construction of the masonry wall 4 can start at that level. The lintel 20 could also be positioned above the concrete floor for supporting, for example, the frame of a window.

As illustrated on FIGS. 10 and 11, two prefabricated form assemblies 10 may be pre-assembled to form prefabricated corners 80. The corners 80 may be inside (FIG. 11) or outside (FIG. 10) depending on where the anchor elements 30 are placed. The corners 80 may also be suspended or supported by the adjustment bars 70 of the assembly 10, allowing, for example, windows or doors to be built in the corners 80 of a building.

The present invention also concerns a method for making a concrete floor 2. The builder has to select several prefabricated form assemblies 10, including the corners 80, in function of the final desired shape of the concrete floor.

After the installation of a temporary supporting floor 90, generally made of plywood, the components of the form assembly 10 are assembled together. Concrete is then poured into a form wherein the elongated form plate 12 acts as a stopper for the flow of concrete and hence acts as a mould panel. The form plate 12 is solidly anchored to the slab as the concrete hardens or cures by the direct contact of its back surface with the latter and also, mostly, by the presence of the anchoring elements 50 embedded in the slab 2 and attached to the form plate 12. Once the concrete material is set, the temporary supporting floor 90 may be removed safely. During the pouring of the concrete and hardening of the latter, the lintel 20 provides support for lateral forces by the concrete on the form plate 12.

The set up and installation of the assembly may readily be performed through a set of quick and ergonomic steps by a single class of workmen, typically the concrete/form workers. Alignment of the lintel 20 with respect to a vertical line may be readily performed using the shim plates 60 and its alignment with a horizontal line may be performed thanks to the vertical slots 28 provided therein. The shim plates 60 may be readily put in place by simply loosening the exterior nut and bolt combination, slightly pulling the lintel 20 out and then retightening the exterior nut and bolt combination without requiring that the lintel 20 be pulled out completely from the anchoring element 50. In order to allow for horizontal alignment the lintel 20 may be lowered or raised to the proper elevation. The vertical and horizontal adjustment may be performed, for example, by the masonry workers once the concrete has hardened prior to the mounting of bricks on the lintel.

Although preferred embodiments have been described in details, it is worth mentioning that the present invention is not limited to these embodiments and that any modifications to these preferred embodiments within the scope of the present invention is not deemed to alter or change the nature and scope of the invention.

What is claimed is:

1. A prefabricated form assembly for making a concrete floor, comprising:

a) an elongated form plate having a front and a back face, for forming and re-taining a flowable concrete material before it sets;

b) at least one anchor element extending from the back face of the form plate, and being designed to be embedded into the concrete floor;

c) a substantially L-shaped lintel having a back wall connected to the front face of the form plate and a bearing wall for supporting a masonry wall; and d) at least one spacing element interconnecting the lintel to the form plate, thereby leaving a gap between the form plate and the lintel, and being provided with a screw-receiving hole for receiving an adjustable fastener;

wherein the lintel is vertically movable with respect to the form plate for levelling the masonry wall;

wherein the back wall of the lintel is provided with at least one vertical slot, each being adapted to receive the adjustable fastener for connecting the back wall to a re-spective one of said spacing elements, the vertical slot allowing the lintel to be movable with respect to the form plate; and wherein the adjustable fastener comprises:

a bolt, having a threaded shank inserted through the vertical slot of the lintel and the screw receiving hole of the spacing element, the bolt having a head abutting the back wall of the lintel; and a nut mounted on a free end of the threaded shank, whereby the level of the lintel is adjustable by loosening the bolt.

2. The prefabricated form assembly according to claim 1, wherein the at least one spacing element has a substantially U-shaped cross-section with a base wall and two lateral walls, the lateral walls being secured to the front face of the form plate and the base wall facing the back wall of the lintel.

3. The prefabricated form assembly according to claim 2, wherein each of said anchor element has a rod-shaped portion crossing the form plate and having an end secured to the base wall of a respective one of said at least one spacing element.

4. The prefabricated form assembly according to claim 3, wherein each of said anchor element has a rod-shaped portion crossing the form plate, a respective one of said spacing elements and of said vertical slots in the lintel, said anchor element having a threaded end jutting out of the back wall of the respective lintel, and the adjustable fastener comprising a nut screwable on the threaded end of the anchor element.

5. The prefabricated form assembly according to claim 2, wherein each of said anchor element has a rod-shaped portion crossing the form plate, the rod-shaped portion has an end part secured to an outer face of a corresponding one of said lateral walls of the spacing element.

6. The prefabricated form assembly according to claim 5, comprising two of said anchor elements associated with each one of said spacing elements.

7. The prefabricated form assembly according to claim 2, further comprising;

an adjustment bar associated with at least one of said spacing element, said adjustment bar being slidable within a vertically extending through hole delimited by the lateral walls and base wall of said at least one of said spacing element, and the adjustment bar comprising a plurality of fastener-receiving holes placed along the bar and being adapted to receive a fastener, each of the fastener-receiving holes being positionable in front of the screw-receiving hole of the base wall of the spacing element by sliding the bar upwardly or downwardly with respect to the spacing element; and at least one fastener element to secure the adjustment bar to the spacing element.

8. The prefabricated form assembly according to claim 7, wherein the bar is a U-shaped bar.

9. The prefabricated form assembly according to claim 2, wherein the nut is fixed to the base wall of the spacing element in order to facilitate the screwing of the bolt.

10. A method for making a concrete floor comprising the following steps of:

a) providing a plurality of prefabricated form assemblies as defined in claim 1;

b) installing a temporary supporting floor and assembling the form plates of said prefabricated form assemblies to form a mould, the anchor element(s) of the prefabricated form assemblies extending into the mould;

c) pouring a flowable concrete material into the mould;

d) letting the flowable concrete material to set; and e) removing said temporary supporting floor.

11. A method for making a concrete floor according to claim 10 comprising, after step d, the step of:

e) building a masonry wall supported by the lintels of prefabricated form assemblies.

* * * * *